US007780555B2

(12) United States Patent
Wong et al.

(10) Patent No.: US 7,780,555 B2
(45) Date of Patent: Aug. 24, 2010

(54) INFLATABLE BALL WITH PREDICTABLE MOVEMENTS

(75) Inventors: Jacob Y. Wong, Goleta, CA (US); Chi Wai Tse, Hong Kong (CN)

(73) Assignee: Gamelot, Inc., Goleta, CA (US)

( * ) Notice: Subject to any disclaimer, the term of this patent is extended or adjusted under 35 U.S.C. 154(b) by 46 days.

(21) Appl. No.: 12/214,904

(22) Filed: Jun. 20, 2008

(65) Prior Publication Data

US 2009/0318054 A1 Dec. 24, 2009

(51) Int. Cl.
*A63B 43/04* (2006.01)

(52) U.S. Cl. ..... 473/594; 473/595; 473/604

(58) Field of Classification Search ..... 473/570, 473/594, 595, 600–602, 603, 604, 609, 610; 446/221

See application file for complete search history.

(56) References Cited

U.S. PATENT DOCUMENTS

| | | | | | |
|---|---|---|---|---|---|
| 1,668,143 | A | | 5/1928 | Daasch | |
| 2,499,483 | A | | 3/1950 | Foy | |
| 2,625,770 | A | * | 1/1953 | Steen et al. | 473/610 |
| 3,370,851 | A | | 2/1968 | Murray | |
| 3,655,197 | A | * | 4/1972 | Milbaum | 473/594 |
| 4,822,044 | A | * | 4/1989 | Perkitny | 473/570 |
| 4,834,382 | A | * | 5/1989 | Spector | 473/603 |
| 4,842,563 | A | * | 6/1989 | Russell | 446/221 |
| 4,915,669 | A | * | 4/1990 | Russell | 446/221 |
| 4,917,381 | A | * | 4/1990 | Spector | 473/594 |
| 5,000,451 | A | | 3/1991 | MacDonald | |
| 5,070,610 | A | * | 12/1991 | Leslie | 473/594 |
| 5,098,329 | A | * | 3/1992 | Tseng | 446/221 |
| 5,219,162 | A | | 6/1993 | Orbanes | |
| 5,924,942 | A | * | 7/1999 | Gentile | 473/570 |
| 5,947,845 | A | | 9/1999 | Canelas | |
| 6,056,622 | A | | 5/2000 | Chung | |
| 6,158,390 | A | | 12/2000 | Holtier | |
| 6,398,616 | B1 | | 6/2002 | Motosko, III | |
| 6,537,125 | B1 | | 3/2003 | Motosko, III | |
| 6,572,499 | B2 | * | 6/2003 | Davies | 473/604 |
| 7,520,830 | B2 | * | 4/2009 | Wong | 473/594 |
| 2007/0037636 | A1 | | 2/2007 | Wong | |
| 2007/0037641 | A1 | | 2/2007 | Wong | |

* cited by examiner

*Primary Examiner*—Steven Wong
(74) *Attorney, Agent, or Firm*—Roy L Anderson; Wagner, Anderson & Bright, LLP

(57) ABSTRACT

A ball having an inflatable ball shell within which is found an inflatable inner ball partially filled with an inner ball gas and partially filled with a liquid that is held in the center of the inflatable ball shell by an inflatable support when the inflatable inner ball, the inflatable ball shell and the inflatable support are inflated. The ball exhibits an eccentric and unpredictable motion unless a concomitant spin is appropriately applied to it and the motion of the ball is primarily determined by movement of the liquid within the inflatable inner ball. The inflatable support can be a donut-shaped chamber having an inner radius which is substantially the same as, and may be attached to, an outer radius of the inflatable inner ball. Alternatively, the inflatable support can be three or more elastic spherical shells attached to the inflatable inner ball.

12 Claims, 2 Drawing Sheets

INFLATABLE BALL WITH PREDICTABLE MOVEMENTS

FIELD OF THE INVENTION

The present invention generally relates to toy balls of various sizes such as beach balls, and more particularly to an inflatable ball of the type used for recreational and other purposes. In particular, the presently invented ball exhibits predictable rolling and in flight characteristics when it is kicked or putted with a concomitant application of a particular spinning action which will influence to a large extent the subsequent motion of the ball on the ground or in the air.

BACKGROUND OF THE INVENTION

Inflatable balls, such as beach balls and the like, have been well known and enjoyed widespread worldwide marketing and monetary success for decades. Inflatable balls are generally constructed out of a thin flexible outer skin, such as thin sheet rubber, plastic and the like. It is typically provided with an airtight stem valve molded into the outer skin for putting air into the ball with some degree of pressure adjustments. Because of the lightweight structure and elasticity of the inflated ball, the bouncing and throwing characteristics are very appealing and unpredictable.

Over the years quite a large number of inventors have sought to improve or add features to a standard ball so that people can derive even more pleasure, fun and satisfaction from playing with it. These features include 1) ball luminosity so that one can play with a luminous ball after dark; 2) sound emission so as to amuse small children and arouse their curiosity; 3) erratic and unpredictable ball movement having a swingable variable internal bladder filled with water which causes the inflatable ball to move in an erratic and unpredictable manner for greater playing enjoyment, and so on. But the present inventors have yet another idea. By incorporating features within an inflatable ball so as to make its motion predictable to a large extent by acquiring a special skill or training practice, this novel inflatable ball can be rendered the cornerstone for a totally new sporting game called the "Sokker Golph" as will be described briefly below.

For over a century, the game of golf has always been considered as a game of high prestige and esteem. No doubt this is at least partially so because golf requires not only a player's developed skill but also one's mastery over one's mind when the game is played. In this respect golf is truly a unique game of its own unmatched by any others in the sporting world. Unfortunately for many people, golf has also been developed over the years for people of means. It has been looked upon as a rich man's game requiring not only expensive equipment to play (e.g. the golf club set and bag) but also fashionable attire and exquisite golf courses associated with country clubs accessible to those lucky few that can afford such means, and golf still remains one of the most expensive sporting games for people to play. It is of interest to note that golf today still has not been recognized and listed as a competitive sporting event in the Olympic Games.

On the other hand, the game of soccer has been considered for a long time by many as the most popular and beloved sporting game of the world. Only until recently soccer was not a popular game in the United States primarily because of the co-existence of the enormously popular game of American football. Over the past decade or so, the popularity of soccer in the United States has grown significantly. Today soccer is just as popular, if not more so, as little league baseball for elementary school children, boys and girls alike. In the coming years it is difficult not to believe that soccer will rank equally in enthusiasm and support alongside with American football, baseball, ice hockey and basketball as the most popular seasonable sporting games in the United States.

As more and more people play golf in the United States and the popularity of soccer has just about gone through the roof in about the same time span, particularly in the United States, an opportunity presents itself for introducing a game that combines the striking features of these two popular and beloved games into one that is more accessible to ordinary people. Such a game, called "Sokker Golph," is played very much like the regular golf game with a special inflatable ball with predictable movements taking the place of the golf ball and the driving and putting of it replaced by simply kicking or passing this special ball without any need of the golf clubs. Sokker Golph actually mirrors, albeit in a different way, not only the fun and spirit of the game of golf, but more importantly reduces the overall playing cost for the game to the point that almost anybody can afford playing it. For example, whereas golf players pretty much have to practice their game in golf courses or at least in a meticulously manicured putting green in a country club or in some rich folk's backyard, Sokker Golph, like baseball or American football, can be practiced to play almost anywhere such as parks, school yards, open fields or even in the streets. The reason is that the skill required for playing Sokker Golph is to control kicking and passing of a special ball which behaves predictably only when it is kicked or passed with practiced deliberation. This special inflatable ball exhibits an eccentric and unpredictable motion in flight or on the ground when kicked unless a concomitant spin is appropriately applied to it and the present invention is directed to an improved ball capable of being used in playing Sokker Golph. In other words, the currently invented ball only allows properly trained players to control its motion on the ground or in the air. Once this special skill is acquired, good soccer players can take advantage of their ball handling skills in playing the game of Sokker Golph.

Before addressing what is new in the present invention, it is useful to review some prior inventions that have come before the present invention.

Dating back as far as one can remember, it has been almost an unexplainable action for people to kick something that is lying on the ground. It is especially so when the object happens to be a ball. Thus, over the past several decades, various ideas have been advocated via the patent avenue to improve one's skill in kicking the ball, or to improve the features of the ball itself so that people can derive more pleasure, fun or satisfaction while kicking it. This of course is above and beyond people's appetite and strong desire to play or watch all kinds of sporting games involving the use of a ball from as small as the golf ball in the game of golf to the oblong-shaped ball in American football, soccer ball in the game of soccer and basketball in the game of basketball. The only exception is the game of ice Hockey when a disc called a "puck" is used instead of a ball.

In U.S. Pat. No. 1,668,143 issued to Daasch in 1928, the inventor advances a novel type of sounding toy in the form of a hollow ball having a sound producing member disposed therein so that when the ball is placed in motion, an intermittent sound will be pronounced and emitted from the ball. The object is to amuse small children and arouse their exciting curiosity when they play with the ball of this invention.

In U.S. Pat. No. 2,499,483 issued to Foy in 1950, the author invented a rolling, audible and visual toy, comprising a hollow thin sphere formed of transparent plastic material, a flat thin metal double-faced mirror arranged within the sphere and extending diametrically of the same and having its marginal edge attached to the sphere, and colored balls arranged within the sphere upon opposite sides of the mirror. This invention relates to toys for infants.

In U.S. Pat. No. 3,370,851 issued to Murray in 1968, an art of kicking a football was introduced. This invention advances a provision in a football of means visible to the kicker during the process of kicking the ball for insuring its correct orientation relatively to the kicking foot for obtaining uniformly accurate results for each of the different types of kicks. The official rules of NCAA define the ball used in the game of football as having the shape of a prolate spheroid and it is due to this shape of the ball it has been quite difficult to master the art of producing accurately directed and properly executed so-called "end-over-end" and "spiral" punts. These punts are those which the football rules define as being a kick by the player who drops it from his hands and kicks it before it strikes the ground. This invention advances three sets of clearly delineated, visible guide marks formed on the laced top of the ball in order to allow the kicker to apply the correct spin on the ball for achieving the best results.

In U.S. Pat. No. 4,842,563 issued to G. K. Russell in 1989, an inflatable ball is disclosed having eccentric flight and bounce characteristics. Russell teaches an inflatable ball with a swingable variable internal bladder which, when filled with water, will cause the inflatable ball to move in an erratic fashion for greater playing enjoyment. The movement is typically described as being orbital in nature.

In U.S. Pat. No. 5,000,451 issued to Macdonald et al. in 1991, the authors disclosed a game football which can be stabilized in flight by weighted material that responds to spinning of the football about its major axis by moving radially outwards to become evenly distributed about that axis. Two annular tubes, concentrically disposed about the major axis encircle the ball at opposite sides of a plane containing the minor axis of the ball. The weighted material, in the form of beads, liquid, etc. is contained within the tubes and is flung radially outward as the ball spins.

In U.S. Pat. No. 5,219,162 issued to Orbanes et al. in 1993, the inventors advanced a toy ball having a body of solid foam plastic material and a noisemaker completely embedded within the foam plastic body. The noise maker includes a hollow rigid housing made out of plastic and a marble within the housing free to roll around therein so as to create a clattering sound when the ball is shaken, thrown or caught.

In U.S. Pat. No. 5,947,845 issued to Canelas in 1999, the inventor advances a combination of a pair of soccer shoes and a soccer ball wherein each of the shoes and the ball have an exterior surface marked with selected areas of differing shapes and colors. The markings on the shoes correspond in shape and color to the markings on the exterior of the ball in order to instruct a kicker where to kick the ball with each portion of his or her foot in order to make the ball move in desired directions.

In U.S. Pat. No. 6,056,622 issued to Chung in 2000, unpredictable bounce characteristics are imparted to a ball by forming the ball as a composite wherein a second ball part is disposed within a first ball part with the centers of each ball part spaced one from the other. Such an unpredictable motion of the ball upon kicking by the player serves to add more fun to the playing with the ball. In a first embodiment of this invention, the second part is of the relatively high bounce ball type that is disposed in an off-center cavity formed in the first ball part which is fabricated from sponge-like rubber. In a second embodiment the first ball part is of the relatively high bounce ball type and the second ball part is an air filled cavity spaced from the center of the first ball part. The manner in which this composite ball can be fabricated in practice is also disclosed.

In U.S. Pat. No. 6,158,390 issued to Holtier et al. also in 2000, a toy ball especially useful for pets which includes a suspended weight positioned at the center of a tensionable elastic member is taught. The outer member is formed of rigid plastic semi-spheres.

In U.S. Pat. No. 6,398,616 B1 issued to Motosko, III in 2002, the inventor advanced an inflated ball comprising an outer chamber formed of an air-tight flexible outer skin which, when properly inflated and fully expanded, defines an interior volume. A sealed inner chamber filled with a substance substantially heavier than air is positioned within and occupies a relatively small amount of the interior volume. A plurality of elongated radially extending and three-dimensionally spaced elastic members are each connected and radially extended between the inner chamber and the inner surface of the outer chamber. The elastic members are cooperatively sized in length and suitably tensioned to support and hold the inner chamber centrally in an at-rest position within the interior volume. Each of the elastic members will cooperatively stretch and contract in response to ball movement, such as rolling or being thrown and impact of the ball against a surface, causing the inner chamber to be unpredictably displaced from the at-rest position by gravity and inertia resulting in an erratic movement of the ball.

In a follow-on U.S. Pat. No. 6,537,125 B1 issued also to Motosko III in 2003, a handgrip molded with and radially extending from the outer skin is added so as to enhance sitting and bouncing play action.

In U.S. Patent Application Publication No.: US 2007/0037641 A1 dated Feb. 15, 2007 entitled "Skokker™ Ball," Wong teaches a ball with a hollow inner core filled approximately 50% or less by volume with a liquid (which can include metallic spheres), a ball shell and struts (six or more) attached to the core and connected to an inner surface of the ball in such a way so as to always maintain the core at the center of the ball. A swirling motion of the liquid within the hollow inner core determines the motion of the ball and a direction of travel away from a point of contact at which a force is applied to the ball to cause it to move or change direction.

It is evident from the prior arts described above, with the exception of U.S. 2007/0037641 A1 entitled "Skokker™ Ball", that the conceptual implementation of a special ball which behaves unpredictably unless it is being handled in a specifically skillful way, is absent. Since the movements of the earlier disclosed "Skokker™ Ball" are a strong function of a player's invoked action on it, this novel ball could meet the requirement and fulfill the success of the sporting game of Sokker Golph which is the subject of U.S. Patent Application Publication No.: US 2007/0037636 A1 dated Feb. 15, 2007 to Wong entitled "Sporting Game of Sokker Golph." Furthermore, as an inflatable ball with only player-induced predictable movements, the "Skokker™ Ball" is indeed novel and unique and will certainly be welcome and enjoyed by many ball players in numerous occasions throughout the world. However, the disclosed method for manufacturing such a ball, described earlier in terms of production viability, unit production cost and product safety is far from being practical nor satisfactory. The primary objective of the present invention is therefore to advance a new and novel design for the so-called "Skokker™ Ball", to be used not only in the sporting game of Sokker Golph but also to be enjoyed by millions of people throughout the world, such that its production will be deemed completely viable resulting in a minimum unit manufacturing cost and guaranteeing uncompromising product safety.

SUMMARY OF THE INVENTION

The present invention is generally directed to a ball having an inflatable ball shell within which is found an inflatable inner ball partially filled with an inner ball gas and partially filled with a liquid that is held in the center of the inflatable ball shell by an inflatable support when the inflatable inner ball, the inflatable ball shell and the inflatable support are inflated.

In a first, separate group of aspects of the present invention, the inflatable support can be a donut-shaped chamber having an inner radius which is substantially the same as, and may be attached to, an outer radius of the inflatable inner ball. Alternatively, the inflatable support can be three or more elastic spherical shells attached to the inflatable inner ball, with each of these shells having a substantially identical radius while the shells are interconnected by tubes so they have a common pressure $P_d$ when the ball is fully inflated.

In a second, separate group of aspects of the present invention, each of the inflatable inner ball, ball shell and support have an inflation valve (and they may all be located close to each other). Also, the ball shell may have a resealable slit opening through which the inflatable inner ball and the inflatable support can be inserted.

In a third, separate group of aspects of the present invention, the inflatable inner ball has a pressure $P_c$, the inflatable ball shell has a pressure $P_b$ and the inflatable support has a pressure $P_d$ when the ball is fully inflated at which point pressure $P_b$ is slightly less than the pressures $P_c$ and $P_d$, pressure $P_b$ is sufficient so that an overall shape of the ball is maintained and pressures $P_c$ and $P_d$ are adjusted so that an outside surface of the inflatable support is maintained in contact with the inner surface of the inflatable ball shell.

In a fourth, separate group of aspects of the present invention, the ball exhibits an eccentric and unpredictable motion unless a concomitant spin is appropriately applied to it and the motion of the ball is primarily determined by movement of the liquid within the inflatable inner ball. Thus, a swirling motion of the liquid within the hollow inner ball determines the motion of the ball and a direction of travel away from a point of contact at which a force is applied to the ball to cause it to move or change direction, with the direction of travel being to the right when a counterclockwise spin is applied to the ball, to the left when it a clockwise spin is applied to the ball, and straight when a top spin is applied to ball.

In a fifth, separate group of aspects of the present invention, a method is provided for manufacturing the ball of the present invention by inserting an inflatable inner ball attached to an inflatable support inside of an inflatable ball shell having an outer surface and an inner surface and then partially filling the inflatable inner ball with a liquid and then inflating each of the inflatable inner ball and the inflatable support with a gas followed by sealing the inflatable inner ball and the inflatable support inside the inflatable ball shell. Thereafter, the inflatable ball shell can be inflated with a ball gas.

Accordingly, it is a primary object of the present invention to provide a new inflatable ball with special movement characteristics.

This and further objects and advantages will be apparent to those skilled in the art in connection with the drawings and the detailed description of the preferred embodiment set forth below.

DETAILED DESCRIPTION OF THE INVENTION

Figure 1:
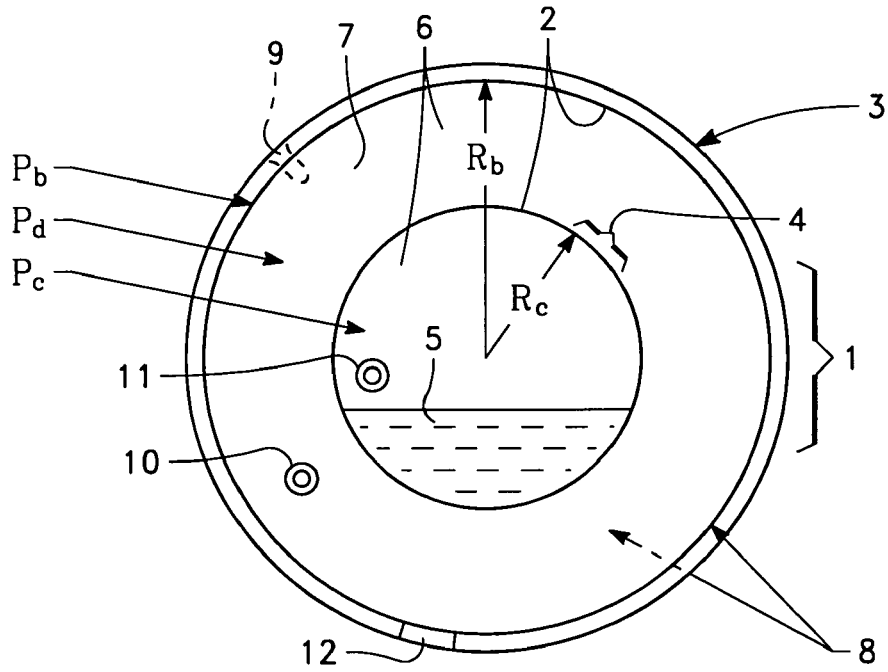
FIG. 1 depicts the schematic layout for the design of a preferred embodiment of an inflatable ball with predictable movements showing its detailed construct.

FIG. 1 depicts the schematic layout for the design of a preferred embodiment of the currently invented ball 1 showing the construct of an elastic Planet Saturn (PS) shaped chamber assembly 2 completely enclosed by an air-tight flexible outer wall or skin 3 of the currently invented ball 1. The PS shaped chamber assembly 2 comprises a centrally located elastic spherical chamber 4 having radius Rc and partially filled with a liquid 5 such as water and appropriately pressurized with air 6 to a pressure Pc. Permanently attached to the central chamber 4 around its equator 6 is an elastic donut-shaped chamber 7 having an inner radius Rc, the same as that for the central chamber 4, and an outer radius of Rb equal to the inner radius of the outer wall of the ball 1. The donut-shaped chamber 7 is also appropriately filled with air to pressure Pd. The cross-sectional area of the donut-shaped chamber 7, which is equal to it $\pi[(Rb-Rc)]/2)2$ is considerably smaller than the cross-sectional area of the ball 1. Hence there is ample space left inside ball 1 not occupied by the PS shaped chamber assembly 2 even if the latter is appropriately inflated.

The air pressure for the remaining inner space 8 of ball 1, not occupied by the elastic PS shaped chamber assembly 2 is denoted by Pb, which has a slightly different value from those of Pc or Pd. Also shown in FIG. 1 are three stem air valves 9, 10 and 11 for letting air into or out of ball 1, the donut-shaped chamber 7 and the central spherical chamber 4, respectively. Air valves 10 and 11 are purposely located to be close to each other. The reason for doing this will be given later below. A re-sealable slit opening 12 typically less than 2.0" long and 0.025" wide allows the insertion of the entire deflated PS shaped chamber assembly inside the ball 1 during production is located on the air-tight flexible outer skin 3 as depicted in FIG. 1.

As shown in FIG. 1, the currently invented inflatable ball 1 comprises an air-tight flexible outer skin 3 such as thin sheet plastic, rubber and the like, which, when properly inflated and fully expanded, defines an interior volume 8 wherein a properly inflated PS shaped chamber assembly 2 fits snugly. Once inside the interior volume 8 of the ball 1, the pressures Pc and Pd of the central spherical chamber 4 and the donut-shaped chamber 7 respectively are appropriately adjusted so that the surfaces of the latter are snugly pushing against the inside of the ball's outer skin 3. Such a snug fit will guarantee that the central spherical chamber 4 will be maintained always at the center of ball 1. This is the case as long as Pb, the pressure of the ball's inner space, is always kept slightly below that of Pd and Pc. However, the values of Pd and Pc must be properly adjusted during production so that Pb can always be kept high enough to ensure the overall shape of the ball 1 to be spherical instead of slightly oblong if the pressure Pb is too low with respect to pressures Pd and Pc.

In designing a ball according to the present invention, outer skin 3 will typically be heavier than material used for the elastic PS shaped chamber. There are two reasons for this. First, outer skin 3 requires a certain degree of toughness, especially if the ball is to be kicked, whereas the elastic PS shaped chamber requires no such toughness. Second, because it is desirable to concentrate the overall weight of the ball in the liquid in central spherical chamber 4, any weight associated with the elastic PS shaped chamber should be minimized.

In order for a ball according to the present invention to exhibit an eccentric and unpredictable motion unless a concomitant spin is appropriately applied to it, the motion of the ball must primarily be determined by movement of liquid 5 within interior volume 8 of central spherical chamber 4. This requires liquid 5 to have sufficient weight, relative to the overall total weight of the ball, to influence the ball's motion. It also requires that interior volume 8 is sufficiently large, relative to the volume displayed by liquid 5, so that liquid 5 has space to swirl within interior volume 8 to thereby affect movement of the ball. For example, it has been found that if central spherical chamber 4 has half the diameter of the ball, and water is used as liquid 5, the ball will function properly when roughly one-quarter of interior volume 8 is filled with the water when the weight of such water is approximately one-third to one-half of the total weight of the ball.

Because of this special design of ball 1 as depicted in FIG. 1 and subsequently described above, it behaves very differently from a regular inflatable ball upon either being kicked or struck (putted). This difference in behavior is attributed to the unpredictable movement of liquid 5 that partially occupies the central spherical chamber 4 upon being kicked or struck. Thus, unlike kicking a regular inflated ball whose direction of travel depends primarily upon the kicker's aim and optional spin, the travel direction of the currently invented ball 1 is simply unpredictable unless it is being kicked or struck in a special manner as explained below.

Figures 2A, 2B, 2C:
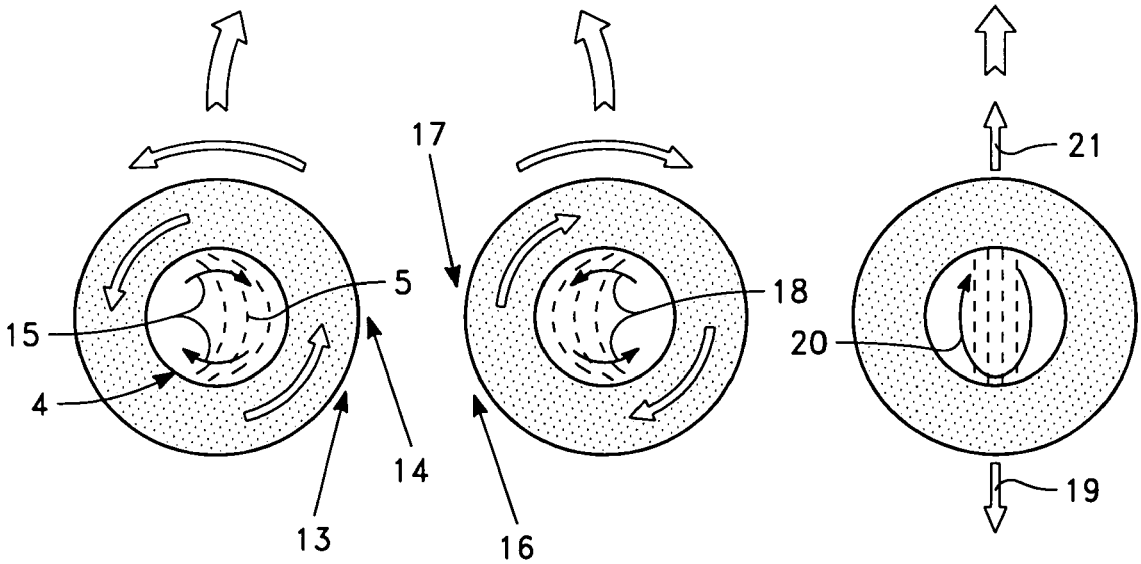
FIG. 2 depicts the directional motion of the currently invented ball when a spin is concomitantly applied to a) right side of the ball; b) the left side of the ball and c) the top surface of the ball with the kicking.

To determine the travel direction of ball 1 upon either being kicked or struck (putted), a spin must be imparted onto the ball in order to control the motion of the partially filled liquid 5 in the central spherical chamber 4 of the ball 1. In other words, the spin imparted onto the ball 1 will cause liquid 5 inside central chamber 4 to swirl substantially in a well-defined manner such as a clockwise, counterclockwise, top to bottom or bottom to top spinning direction as depicted in FIG. 2. It is this swirling motion of the liquid at the central chamber 4 of the ball 1 that will determine the motion of the ball and its subsequent direction of travel. In other words unless the ball 1 is kicked or struck in a deliberate fashion, ball 1 will have a mind of its own upon being casually kicked or struck and will travel in a totally uncontrollable and unpredictable manner.

As shown in FIG. 2(*a*) when a counterclockwise spin 13 is applied to the right side 14 of ball 1 while it is being kicked or struck, an equivalent clockwise spinning effect 15 is imparted to liquid 5 inside central chamber 4 thus causing the directional motion of ball 1 to the right. When a clockwise spin 16 is applied to the left side 17 of ball 1 while it is being kicked as shown in FIG. 2(*b*), an equivalent counterclockwise spinning effect 18 is imparted to liquid 5 inside central chamber 4 thus causing the directional motion of ball 1 to the left. In FIG. 2(*c*) when a top spin 19 is imparted to the ball while it is kicked, the effective spinning on liquid 5 inside central chamber 4 remains in the vertical plane 20 and the ball will subsequently go in a straight direction 21 without swirling left or right. The examples given above are for pure spin actions only. In actuality this seldom happens and the spin imparted to the ball by the kicker is some kind of a mixture of spin actions illustrated in FIG. 2. Nevertheless, it is possible to control the directional motion of ball 1 in flight or on the ground by applying a deliberate and appropriate spin to it while kicking or striking (putting) same. In one extreme situation, ball 1 could be made to behave like a boomerang to come back right at the kicker after it is appropriately kicked. However, it would take a lot of practice and trial before one can achieve such a feat.

Thus, unlike many balls advanced earlier that produce for fun erratic and uncontrollable movements, or making random clattering sounds, or can be lighted up in the dark, the currently invented ball 1 is special in that its motion in flight or on the ground is totally controllable by the player. However, a player must learn, through a lot of training and practice, to control its directional motion, either in flight or on the ground. Such is desirable if ball 1 is to be used for the game of Sokker Golph. This is because a sporting game has hardly any meaning in playing if everything about playing it is pretty much left to luck or accidental happenings. The game of golf will never be the same if there is no control of driving or putting the ball through a lot of hard work, practice and self-discipline. Similarly, even for the game of soccer, it would not be the same game if the ball could not be skillfully controlled by the players, again through a lot of practice and hard work, but is left only to random and unpredictable motions.

Figure 3:
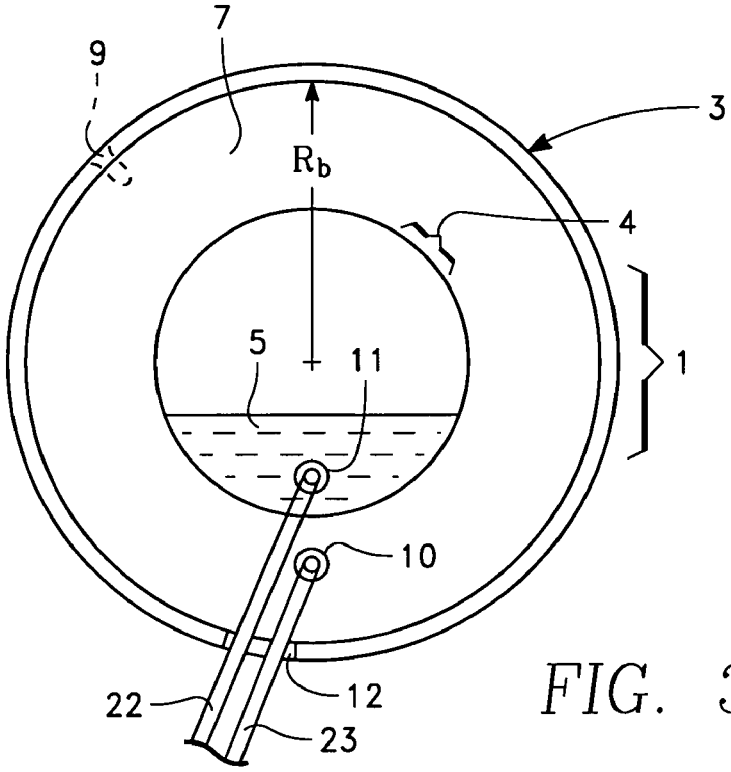
FIG. 3 shows the detailed design for the elastic Planet Saturn shaped chamber assembly with the tubes used to fill the chambers inside with liquid and air during production.

As alluded to earlier, the primary objective of the presently invented ball 1 is to render its production completely viable, straightforward and low cost. With reference to FIG. 1, conventional injection molding techniques of producing inflatable balls of all types with the use of airtight, elastic and flexible outer skins such as sheet plastic, rubber and the like can be utilized to fabricate the presently invented ball 1. As an example, the steps to manufacture an eight-inch diameter currently invented ball 1 will be described below. FIG. 3 shows schematically the outer skin or wall 3 of a ball 1. The radius of ball 1, Rb, is taken to be four inches (4 in.). The outer skin 3 is typically made out of sheet plastic, rubber or the like with a thickness ranging from 0.015" to 0.030" and a density ~5.0 gm/cc. A standard stem air valve 9 is molded onto the outer skin for inflating or deflating the ball. A special re-sealable longitudinal slit 12 with a typical length of ~2.0" and a width of ~0.025" is also molded onto the outer skin 3 as shown in FIG. 3. This special re-sealable slit 12 enables the insertion of the entire deflated elastic PS shaped chamber assembly 2 into the interior space 8 of ball 1 during production (see below). It also allows two tubes 22 and 23 equipped with air needles inserted into air valves 10 for the donut-shaped chamber 7 and air valve 11 for the central spherical chamber 4 respectively to protrude outwards from it. The tubes 22 and 23 are used to fill the central chamber 4 with liquid, for example water, and air and the donut-shaped chamber 7 with air respectively during production.

As an example for fabricating an eight in. (8") diameter currently invented ball 1, the radius Rc for the central spherical chamber 4 and the radius of the cross-section of the donut-shaped chamber, namely (Rb−Rc)/2, are 2.0" and 1.0", respectively. The thickness of the elastic PS shaped chamber assembly 2 should be roughly half the thickness of the outer skin 3 or ~0.013". Assuming the density of the sheet plastic or rubber used is ~5.0 gm/cc, the overall weight of the 8.0" diameter ball 1 excluding the liquid in the central spherical chamber 4 is around 4.5 oz. The ideal amount of liquid in the central spherical chamber for producing the optimum swirling effects is ~86 cc of water or ~3.0 oz. Thus the overall weight of the currently invented ball 1 is around 7.5 oz which is ideal for a general purpose inflatable recreational ball.

Needless to say, the dimensions for the various constituents of the currently invented 8" diameter ball 1 as an example will not be the same for different balls to be used under different circumstances.

As alluded to above, both the outer skin 3 and the elastic PS shaped chamber assembly 2 can be readily manufactured using conventional inflatable ball molding techniques. The assembly of these two molded parts into the final ball 1 is rather straightforward and will be described below. The first step is to completely deflate the elastic PS shaped chamber assembly 2 and insert tubes 22 and 23 respectively into stem air valve 11 (for the central spherical chamber 4) and stem air valve 10 (for the donut-shaped chamber 7) via standard air pump needles. Step two is to carefully insert the entire deflated elastic PS shaped chamber assembly 2 together with the tubes 22 and 23 into the inner space 8 of the outer skin 3 of ball 1 through the slit 12 (see FIG. 1) leaving part of tubes 22 and 23 dangling outwards. Using tube 22 in Step 3, gently force in ~86 cc (~3 oz.) of water followed by air into the central spherical chamber 4 until a pressure of ~50±10 mmHg is attained. Remove tube 22 entirely from ball 1 through the slit 12. Using tube 23 in Step 5, gently force air into the donut-shaped chamber 7 until a pressure of ~50±10 mmHg is reached. Remove tube 23 from ball 1 through the slit 12. Seal the slit 12 in Step 6 until it is perfectly airtight. Inspect the overall assembled ball 1 for any defects (e.g. leaks) and execute the final Step 7 by inflating ball 1 to a pressure of ~45±5 mmHg or until the overall shape of ball 1 is spherical. The assembly of the currently invented ball 1 is now complete.

Figure 4:
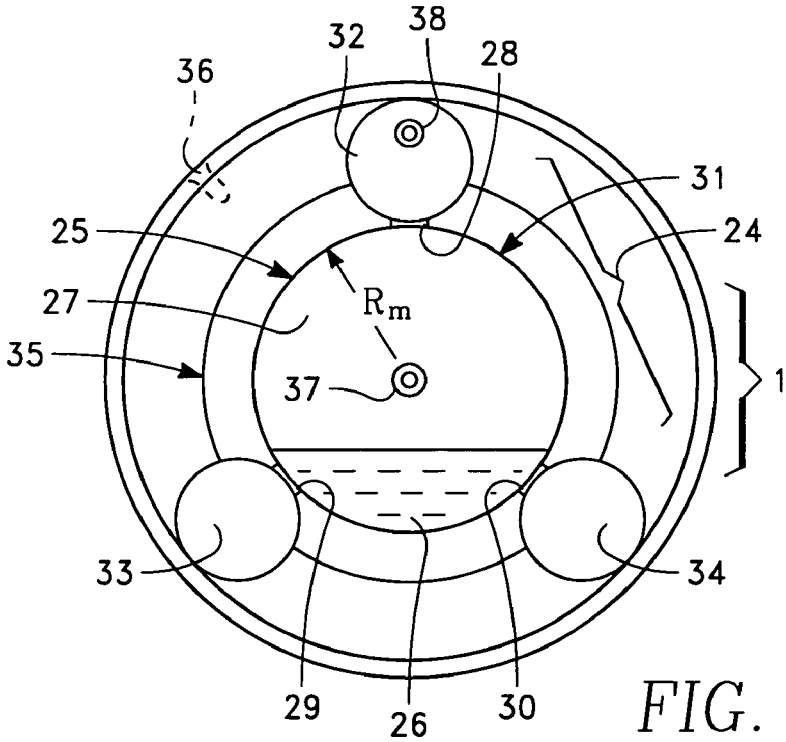
FIG. 4 shows an alternate preferred embodiment for the currently invented inflatable ball with predictable movements.

The use of an elastic Planet Saturn shaped chamber assembly for the fabrication of the currently invented inflatable ball with predictable movements is one preferred embodiment for the current invention. Another preferred embodiment utilizing an elastic multi-chamber assembly is depicted in FIG. 4. As shown in FIG. 4, The elastic multi-chamber assembly 24 comprises a centrally located elastic spherical shell 25 having radius Rm and partially filled with a liquid 26 such as water and appropriately pressured with air 27 to a pressure Pm. Permanently attached to the central spherical shell 25 at locations 28, 29 and 30 respectively along its equator 31 are three independent elastic spherical shells 32, 33 and 34 interconnected via tubes 35 and all having the same small radius Rs. The three elastic shells 32, 33 and 34 whose centers lie on the equatorial plane of the central elastic spherical shell 25 defined by its equator 31 are 120° apart from one another with respect to the latter's center. Also shown in FIG. 4 are three stem air valves 36, 37 and 38 for letting air respectively into ball 1, the central elastic spherical shell 25 and the common air space shared among the three adjoined elastic spherical shells 32, 33 and 34.

The remaining construction steps for this embodiment of the present invention are identical to those described earlier for the first preferred embodiment.

Thus, there has been described above the salient features of two embodiments for the current invention. While the invention has been described herein with reference to certain preferred embodiments, those embodiments have been presented by way of example only, and not to limit the scope of the invention. Additional embodiments thereof will be obvious to those skilled in the art having the benefit of this detailed description.

Accordingly, it will be apparent to those skilled in the art that still further changes and modifications in the actual concepts described herein can readily be made without departing from the spirit and scope of the disclosed inventions as defined by the following claims.

What is claimed is:

1. A ball, comprising:

an inflatable inner ball partially filled with an inner ball gas and partially filled with a liquid;

an inflatable ball shell having an outer surface and an inner surface; and an inflatable support for holding the inflatable inner ball in the center of the inflatable ball shell when the inflatable inner ball, the inflatable ball shell and the inflatable support are inflated;

wherein the inflatable support is comprised of at least three elastic spherical shells attached to the inflatable inner ball and each of the at least three elastic spherical shells has a substantially identical radius.

2. The ball of claim 1, further comprising a resealable slit opening in the inflatable ball shell through which the inflatable inner ball and the inflatable support can be inserted inside of the inflatable ball shell.

3. The ball of claim 1, wherein the inflatable inner ball has a pressure $P_c$, the inflatable ball shell has a pressure $P_b$ and the inflatable support has a pressure $P_d$ when the ball is fully inflated.

4. The ball of claim 3, wherein the pressure $P_b$ is slightly less than the pressures $P_c$ and $P_d$ when the ball is fully inflated.

5. The ball of claim 4, wherein the pressure $P_b$ is sufficient so that an overall shape of the ball is maintained.

6. The ball of claim 5, wherein the pressures $P_c$ and $P_d$ are adjusted when the ball is fully inflated so that an outside surface of the inflatable support is maintained in contact with the inner surface of the inflatable ball shell.

7. The ball of claim 1, wherein the at least three elastic spherical shells are interconnected via a plurality of tubes so that the at least three elastic spherical shells have a pressure $P_d$ when the ball is fully inflated.

8. The ball of claim 7, wherein the inflatable inner ball has a pressure $P_c$ and the inflatable ball shell has a pressure $P_b$ when the ball is fully inflated.

9. The ball of claim 8, wherein the pressure $P_b$ is slightly less than the pressures $P_c$ and $P_d$ when the ball is fully inflated, the pressure $P_b$ is sufficient so that an overall shape of the ball is maintained and the pressures $P_c$ and $P_d$ are adjusted when the ball is fully inflated so that an outside surface of the inflatable support is maintained in contact with the inner surface of the inflatable ball shell.

10. The ball of claim 1, wherein a swirling motion of the liquid within the inflatable inner ball causes the ball to move in a direction of travel away from a point of contact at which a force sufficient to cause the ball to move is applied to the ball to cause it to move or change direction and said direction of travel of the ball will be to the right when a counterclockwise spin is applied to the ball at the point of contact, the direction of travel of the ball will be to the left when it a clockwise spin is applied to the ball at the point of contact, and the direction of travel of the ball will be straight when a top spin is applied to ball at the point of contact.

11. The ball of claim 1, wherein the ball exhibits an eccentric and unpredictable motion unless a concomitant spin is appropriately applied to it.

12. The ball of claim 11, wherein the motion of the ball is primarily determined by movement of the liquid within the inflatable inner ball.

* * * * *